US006822381B2

(12) United States Patent
Harberts et al.

(10) Patent No.: US 6,822,381 B2
(45) Date of Patent: Nov. 23, 2004

(54) MAGNETIC MATERIAL FILLING FOR VOID SPACES IN DEFLECTION YOKES

(75) Inventors: Dirk Willem Harberts, Eindhoven (NL); Hendrik Dirk Van Den Berg, Eindhoven (NL)

(73) Assignee: Koninklijike Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/145,083

(22) Filed: May 14, 2002

(65) Prior Publication Data

US 2003/0071559 A1 Apr. 17, 2003

(30) Foreign Application Priority Data

May 17, 2001 (EP) ..... 01201869

(51) Int. Cl.[7] ..... H01J 29/70

(52) U.S. Cl. ..... 313/440; 335/210; 445/23

(58) Field of Search ..... 335/210–213; 313/440, 442, 495, 448, 2.1, 433, 431; 445/23

(56) References Cited

U.S. PATENT DOCUMENTS 5,550,522 A * 8/1996 Dekkers et al. ..... 335/213

FOREIGN PATENT DOCUMENTS

WO WO 00/44028 * 7/2000 ..... H01J/29/76

* cited by examiner

*Primary Examiner*—Joseph Williams

(57) ABSTRACT

The invention relates to a deflection yoke (10) for a cathode ray tube (14) in which the energy for deflection is reduced. This is done by providing a magnetic material (56) in voids (52,54) that occur between the ferrite core (10) and a set of frame coils (18). The magnetic material (56) is comprised in a preformed insert (90), which may further comprise a rubber or plastic material. This results in a clean method of adding the magnetic material.

5 Claims, 2 Drawing Sheets

MAGNETIC MATERIAL FILLING FOR VOID SPACES IN DEFLECTION YOKES

Figure 1:
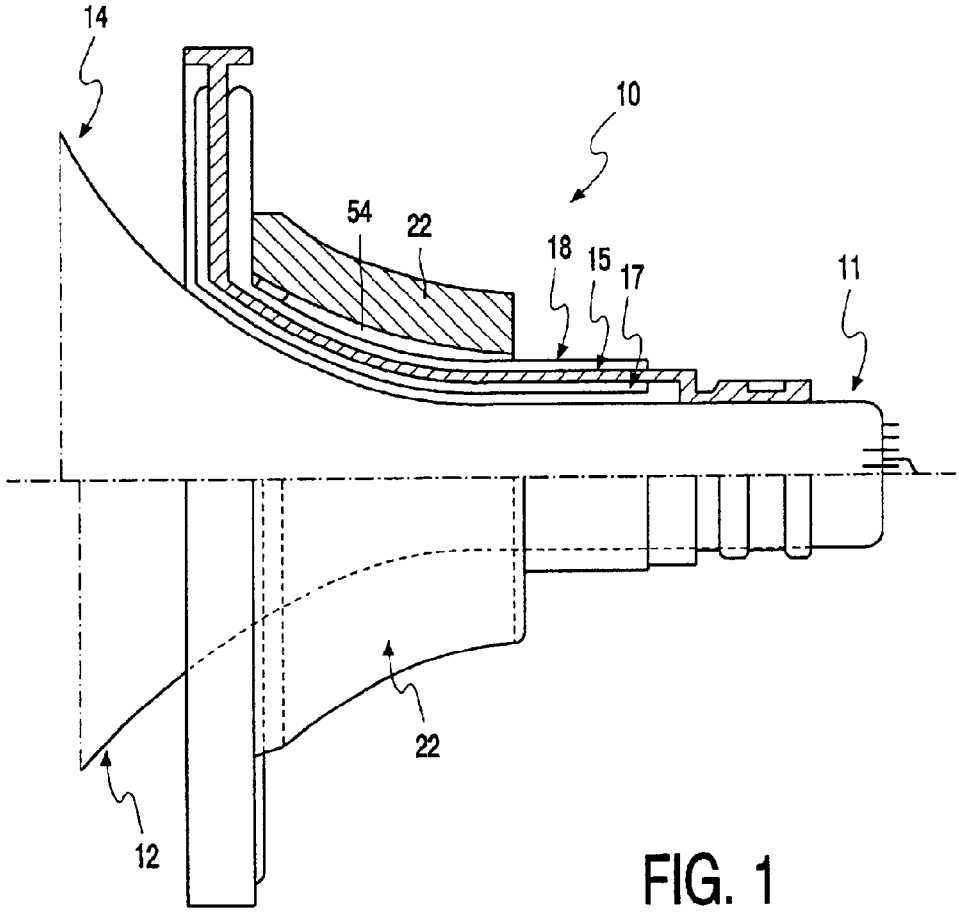

The invention relates to a deflection yoke for a cathode ray tube, the deflection yoke comprising a set of line deflection coils, a set of field deflection coils surrounding the set of line deflection coils, the set of field deflection coils comprising wire strands and having first void spaces between the wire strands, and a ferrite core surrounding the set of field deflection coils, second void spaces being present between the field deflection coils and the ferrite core.

WO 00/44028 describes a deflection yoke (also called deflection unit) for a cathode ray tube in which the first and/or second void spaces are filled with a magnetic material. Thus, external magnetic stray fields are reduced and the sensitivity of the deflection coils is increased.

The magnetic material may comprise a plastic deformable magnetic material, comprising a resinous material containing a filler of soft-magnetic particles, such as small grains of milled ferrite.

The voids may be filled by injection molding or insertion molding. In the case of injection molding, a material is caused to flow out of a nozzle into the voids after exerting a pressure on a reservoir containing the material. By applying a subsequent heating or drying step, the material is immobilized in the voids. Another filling method is provided by insertion molding. In this case, the object to be filled is surrounded by a dedicated mold, whereafter the voids are filled with the material under a relatively high pressure. Both methods of applying the magnetic material have the drawback that the filling process is dirty and cumbersome.

It is an object of the invention to provide a deflection yoke in which the voids are filled with a magnetic material by means of a clean and simple method. The deflection yoke according to the invention is characterized in that the first and/or second void spaces are filled with a preformed insert comprising magnetic particles. The use of a preformed insert renders it no longer necessary to apply a fluid or paste composite containing ferrite particles and provides a very clean method of applying the magnetic particles.

This aspect as well as other aspects of the invention are defined in the independent claims.

Advantageous embodiments are defined in the dependent claims.

These and other aspects of the invention will be elucidated with reference to the embodiments described hereinafter.

Figure 2:
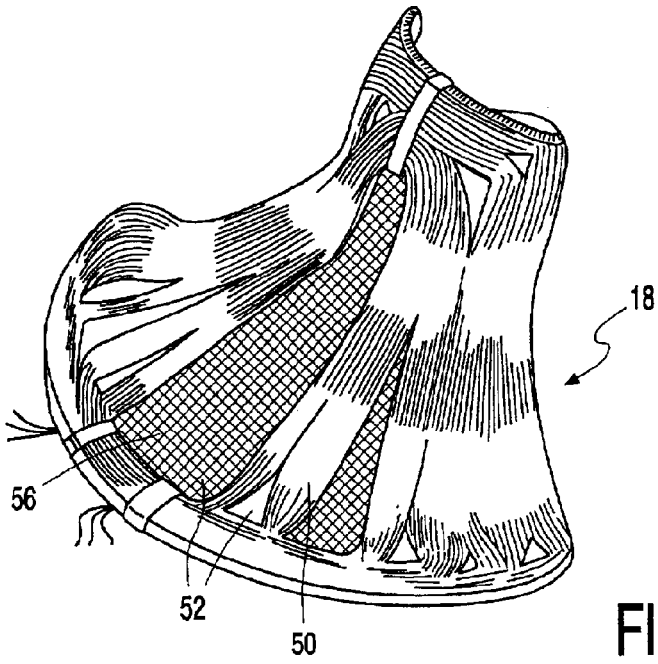
Figure 3:
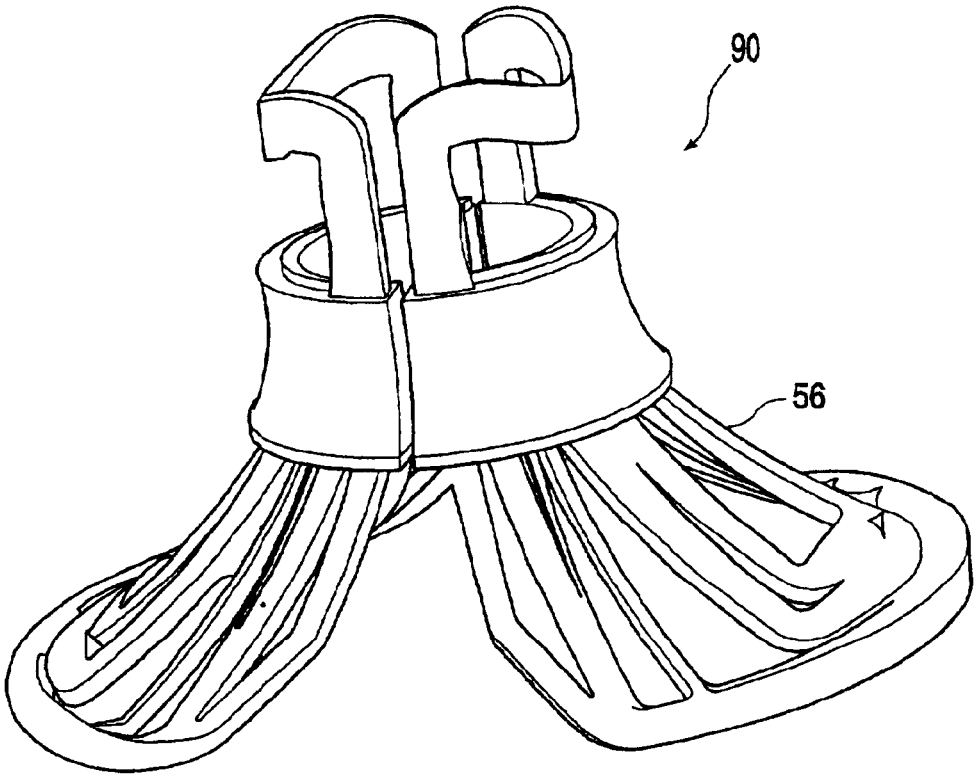
Figure 4:
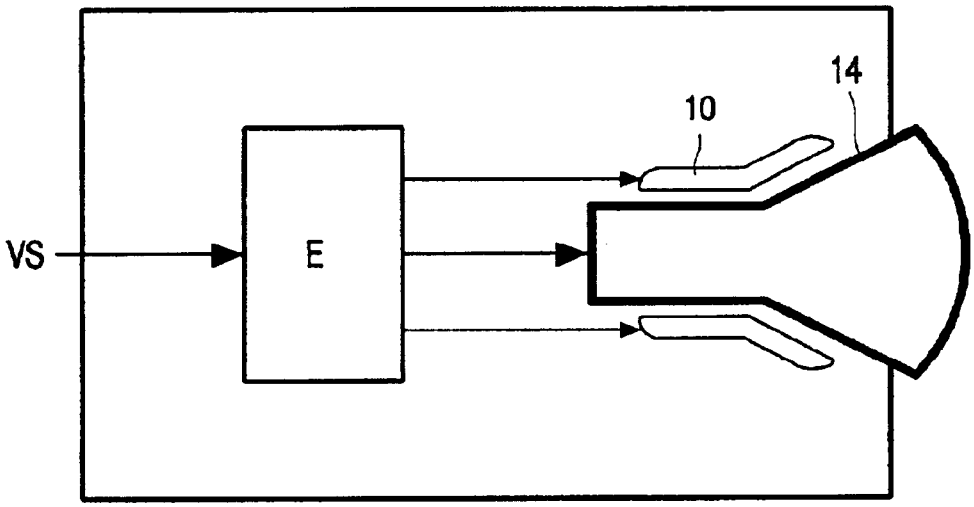

In the drawings,

FIG. 1 shows schematically, partly in a cross-section, partly in a side elevation, a part of a cathode ray tube with an embodiment of the deflection yoke according to the invention, FIG. 2 is a perspective view of a field deflection coil according to the invention, FIG. 3 shows an insert according to the invention, and FIG. 4 shows a display apparatus according to the invention.

Referring to FIG. 1, the deflection yoke 10 is shown mounted on the glass envelope of a cathode ray tube 14 at the region between a neck 11 and a cone portion 12 of the envelope 14. The deflection yoke 10 comprises a coil support 15 of a general frusto-conical shape which carries on its inner side, adjacent the envelope surface, a set of two line (horizontal) deflection coils 17, and on its outer side a set of two field (vertical) deflection coils 18, one of which is shown in FIG. 2, showing in particular first void spaces between the wire strands of the coil.

The coil support 15 together with the sets of deflection coils 17 and 18 secured thereto form a deflection coil assembly. A hollow ring-shaped ferrite core 22 (also known as yoke ring), generally conforming with the outer contour of the coil assembly, is mounted on the outer side of the assembly and fixed thereto. The ferrite core 22 surrounds the coil assembly with its front and rear ends, base, face disposed against an inner portion of the radially-extending part of the coil assembly while its rear, neck, end terminates at an intermediate part of the coil assembly. There are second void spaces 54 between the ferrite core 22 and the field deflection coils 18.

The ferrite core 22 is a sintered molding of soft-magnetic material. The ferrite core 22 serves to short-circuit the magnetic lines of flux outside the coils, which are generated by the field deflection coils during operation. In this way, unwanted external magnetic fields are reduced and the sensitivity of the line deflection is increased. Although the presence of the ferrite core 22 helps to reduce the volume filled by the magnetic field, the magnetic field in the first and second void spaces 52, 54 can still strongly be reduced by filling them with a magnetic material 56. The magnetic material 56 serves to further short-circuit the reminant magnetic flux lines so that a reduction of the external magnetic stray fields is obtained. WO 00/44028 discloses that the voids may be filled by injection molding or insertion molding. In both cases, the magnetic material is applied in a highly viscous fluid-like state, which is caused to dry in a later phase and immobilized in the voids. These methods have the drawback that filling is a dirty and cumbersome process.

An improved filling method is obtained by applying a preformed insert 90 comprising the magnetic material 56, as is shown in FIG. 3. The preformed insert 90 comprises a composite of ferrite powder and a material preferably having elastic properties like rubber or plastic, that fits around—and in the open spaces inside—the field deflection coils 18 and inside the ferrite core 22. The material properties of the rubber or plastic can be adapted to achieve a maximum fit to the geometry of both field deflection coils and ferrite core. For instance, a soft plastic can be used which can be slightly deformed when pressing a ferrite core into its final position. This method is clean, friendly to the environment, resulting in less process spread and allows rework which leads to a cheaper product. Furthermore, since the length of the insert can be chosen independently of the length of the ferrite core, an additional degree of freedom in the design of the insert is obtained.

The insert may be embodied as a solid piece but may also be embodied as two separate ring-shaped halves that are connected during assembly of the deflection yoke.

Since the main reduction of energy is obtained by filling the neck part of the ferrite core, it is advantageous to use a ferrite core which is split into a front part and a neck part and wherein only the coils surrounded by the neck part are filled with the magnetic material. This has the advantage that the front part of the ferrite core can still be shifted to obtain the necessary corrections for winding spread.

Third void spaces occur between the field deflection coils and the line deflection coils, especially between the coil support and the line deflection coils. Inserts that are adapted to the shape of these void spaces may also be used advantageously in this case so as to reduce the magnetic stray fields.

FIG. 4 shows a display apparatus comprising a cathode ray tube assembly, control electronics E coupled to receive a video signal VS to apply a display signal to the cathode ray tube 14 and deflection signals to the deflection yoke 10 in dependence on the video signal VS.

In summary, the invention relates to a deflection yoke 10 for a cathode ray tube 14 in which the energy for deflection is reduced. This is done by providing a magnetic material 56 in voids 52,54 that occur between the ferrite core 10 and a set of field deflection coils 18. The magnetic material 56 is comprised in a preformed insert 90, which may further comprise a rubber or plastic material. This results in a clean method of applying the magnetic material.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

What is claimed is:

1. A method of manufacturing a deflection yoke, comprising:

surrounding a set of line deflection coils with a set of field deflection coils comprising wire strands having first void spaces between the wire strands;

surrounding the set of field deflection coil with a ferrite core such that second void spaces are present between the set of field deflection coils and the ferrite core; and filling at least one of the first and second void spaces with at least one preformed insert comprising magnetic particles.

2. The method of claim 1, wherein the insert comprises an elastic material.

3. The method of claim 1, including filling third void spaces between the set of line deflection coils and the set of field deflection coils with at least a second preformed insert comprising magnetic particles.

4. The method of claim 1, including using the deflection yoke so manufactured in the construction of a cathode ray tube assembly.

5. The method of claim 4, including:

coupling control electronics with the cathode ray tube assembly in the construction of a display apparatus; and applying a display signal to the cathode ray tube and deflection signals to the deflection yoke in response to end dependent on a video signal received by the control electronics.

* * * * *